US008827649B2

(12) United States Patent
Kang et al.

(10) Patent No.: US 8,827,649 B2
(45) Date of Patent: Sep. 9, 2014

(54) FAN ASSEMBLY

(75) Inventors: Myoungju Kang, Seoul (KR); Jindong Kim, Seoul (KR); Hosan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 13/180,599

(22) Filed: Jul. 12, 2011

(65) Prior Publication Data

US 2012/0014800 A1 Jan. 19, 2012

(30) Foreign Application Priority Data

Jul. 15, 2010 (KR) ..... 10-2010-0068235

(51) Int. Cl.
*F04D 29/30* (2006.01)
*F04D 29/38* (2006.01)

(52) U.S. Cl.
CPC ..... *F04D 29/384* (2013.01)
USPC ..... 416/183; 416/189; 416/196 R; 416/228; 416/237

(58) Field of Classification Search
CPC ... F04D 29/383; F04D 29/388; F04D 29/324; F04D 20/326; F04D 19/002
USPC ..... 416/189, 195, 196 R, 228, 237, 183
See application file for complete search history.

(56) References Cited

U.S. PATENT DOCUMENTS

| | | | | | |
|---|---|---|---|---|---|
| 1,620,875 | A * | 3/1927 | Currie | ..... | 416/195 |
| 2,062,513 | A * | 12/1936 | Hipkiss | ..... | 416/5 |
| 2,378,049 | A * | 6/1945 | Upson | ..... | 416/237 |
| 5,226,783 | A * | 7/1993 | Mita | ..... | 416/223 R |
| 8,197,217 | B2 * | 6/2012 | Yamamoto et al. | ..... | 416/228 |

* cited by examiner

*Primary Examiner* — Ninh H Nguyen
(74) *Attorney, Agent, or Firm* — Birch, Stewart, Kolasch & Birch, LLP

(57) ABSTRACT

A fan assembly according to an exemplary embodiment of the present invention includes: a hub; and a plurality of blades including a leading edge corresponding to a side hit by air and a trailing edge corresponding to an opposite side of the leading ledge, the plurality of blades configured to be extended radially from an outer peripheral surface of the hub, wherein each of the plurality of blades includes a first part extended radially from the outer peripheral surface of the hub, a bent part stepped on the end of the first part, and a second part further extended radially on the end of the bent part.

8 Claims, 2 Drawing Sheets

FAN ASSEMBLY

CROSS REFERENCES RELATED APPLICATIONS

The present application claims the benefits of priority to Korean Patent Application No. 10-2010-0068235 (filed on Jul. 15, 2010), which is herein incorporated by reference in its entirety.

BACKGROUND

1. The Field

The present invention relates to a fan assembly.

2. Description of the Related Art

An axial-flow fan in the related art suctions air in an axial direction and discharges air in the axial direction while rotating and used by being coupled with an orifice.

A radial-direction distribution of a flow formed in a general axial-flow fan forms a maximum air quantity around a tip of a blade while the flow is bent out by a centrifugal force. Due to such a phenomenon, a part close to the center of the blade does not play a large role in forming the flow and the flow concentrates on the vicinity of the tip of the blade, such that noise is increased.

THE SUMMARY

The present invention is contrived to solve the problem and has been made in an effort to provide a fan assembly of which noise decreases while an air quantity is increased by improving the shape of a fan so that the center of an axial-flow fan blade also contributes to forming the flow.

An exemplary embodiment of the present invention provides a fan assembly including: a hub; and a plurality of blades including a leading edge corresponding to a side hit by air and a trailing edge corresponding to an opposite side of the leading ledge, the plurality of blades configured to be extended radially from an outer peripheral surface of the hub, wherein each of the plurality of blades includes a first part extended radially from the outer peripheral surface of the hub, a bent part stepped on the end of the first part, and a second part further extended radially on the end of the bent part.

By a fan assembly according to an exemplary embodiment of the present invention configured as above, a blade of an axial fan is configured in 2 stages and an additional orifice is formed on the boundary of the 2-stage blade, the following effects are achieved.

First, a flow formed by an inner part of the blade is bent out by a centrifugal force and a flow direction is changed by the additional orifice, such that noise generated due to a flow inclination or a flow concentration phenomenon is decreased.

Second, an air flow generated by rotation of the blade is independently generated in two regions, such that an air quantity is increased.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, a structure of a fan assembly according to an exemplary embodiment of the present invention will be described in detail with reference to the accompanying drawings.

Figure 1:
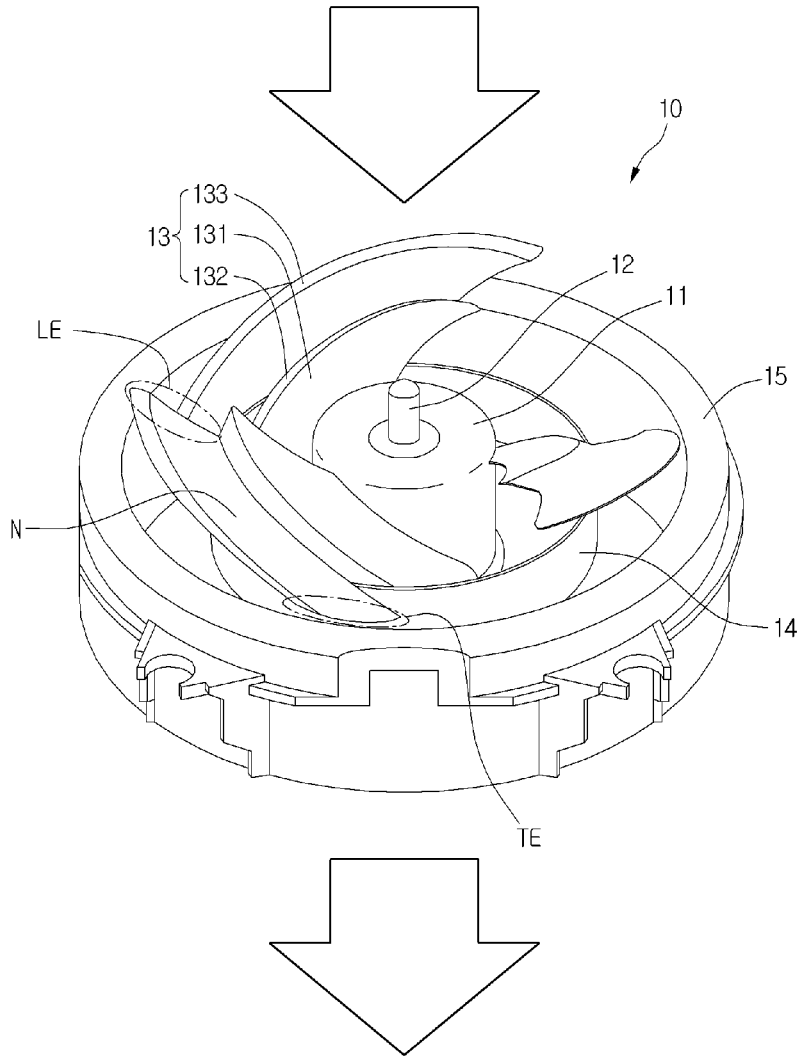
FIG. 1 is a front perspective view of a fan assembly according to an exemplary embodiment of the present invention.

FIG. 1 is a front perspective view of a fan assembly according to an exemplary embodiment of the present invention.

Referring to FIG. 1, the fan assembly 10 according to the exemplary embodiment of the present invention includes a fan inducing a force flow of air and an orifice guiding the forced flowed air to flow in an axial direction of the fan by covering the exterior of the fan.

Specifically, the fan includes a hub 11 which is similar to a circular cone shape with a diameter decreased from the bottom to the top and a plurality of blades 13 radially extended from the outer peripheral surface of the hub 11. In addition, a rotational shaft 12 connected with a fan motor (not shown) protrudes on the upper center of the hub 11.

More specifically, the blade 13 has a shape different from the existing general blade. That is, the blade 13 includes a first part 131 extended from the outer peripheral surface of the hub 11, a bent part 132 stepped from the end of the first part 131 to the bottom of the hub 11, and a second part 133 radially further extended from the bottom of the bent part. An overall shape of the blade 13 is extended toward a radial direction similarly as the blade in the related art. A connection part between the blade 13 and the hub 11 is inclined from the top to the bottom of the hub 11 at a predetermined angle. In other words, a line formed along contact points of the blade 13 and the hub 11 is winded spirally from the top to the bottom of the hub 11.

The general blade in the related art is extended from an inner end to an outer end, however, extended smoothly without a stepped part in the middle. On the contrary, the blade 13 according to the exemplary embodiment of the present invention is extended in the radial direction from the inner end, however, stepped with a predetermined length at any point spaced apart from the inner end by a predetermined distance and thereafter, extended in the radial direction again.

Meanwhile, the orifice includes a first orifice 14 wrapped around the rear surface of the blade 13 corresponding to the part where the bent part 132 is formed and a second orifice 15 having a radius slightly larger than a length from the rotational shaft 12 to the outer tip of the blade 13.

Specifically, the first orifice 14 forms one body with the blade 13 and extends in the axial direction on the rear surface of the blade 13. In other words, the first orifice 14 is wrapped around in a cylindrical shape having a predetermined width (alternatively, length) on the rear surface of the blade 13. In addition, the first orifice 14 is wrapped around along a boundary area between the first part 131 and the second part 133 of the blade, i.e., the area of the bent part 132.

Further, the second orifice 15 is wrapped around in the cylindrical shape on the exterior of the blade 13 and allows air bent in the radial direction while rotating with the second part 133 of the blade 13 to be discharged in parallel to the rotational shaft 12. In addition, the first orifice 14 allows air bent in the radial direction while rotating with the first part 133 of the blade 13 to be discharged in parallel to the rotational shaft 12. Consequently, the addition of the first orifice 14 causes the air flow generated by the rotation of the blade 13 to be divided into two areas or two groups. A detailed description thereof will be described with reference to drawings shown below. The same point as the existing axial-flow fan is in that air suctioned in the axial direction from the front surface of the fan assembly 10 passes through the blade 13 and thereafter, flows out in the axial direction again.

Both sides of the blade 13 are defined as a leading edge LE corresponding to a part firstly hit by air and a trailing edge TE from which air is separated while rotating, respectively. In the figure, since the blade 13 rotates clockwise, a part protruded sharply in a circumferential direction becomes the leading edge LE and an opposite side end becomes the trailing edge TE. In addition, the front surface of the blade, i.e., a discharge surface of air may be defined as a positive pressure surface P (see FIG. 2) and a suction surface may be defined as a negative pressure surface N.

Hereinafter, the air flow generated when the fan assembly 10 according to the exemplary embodiment of the present invention is driven will be described in detail with reference to the drawings.

Figure 2:
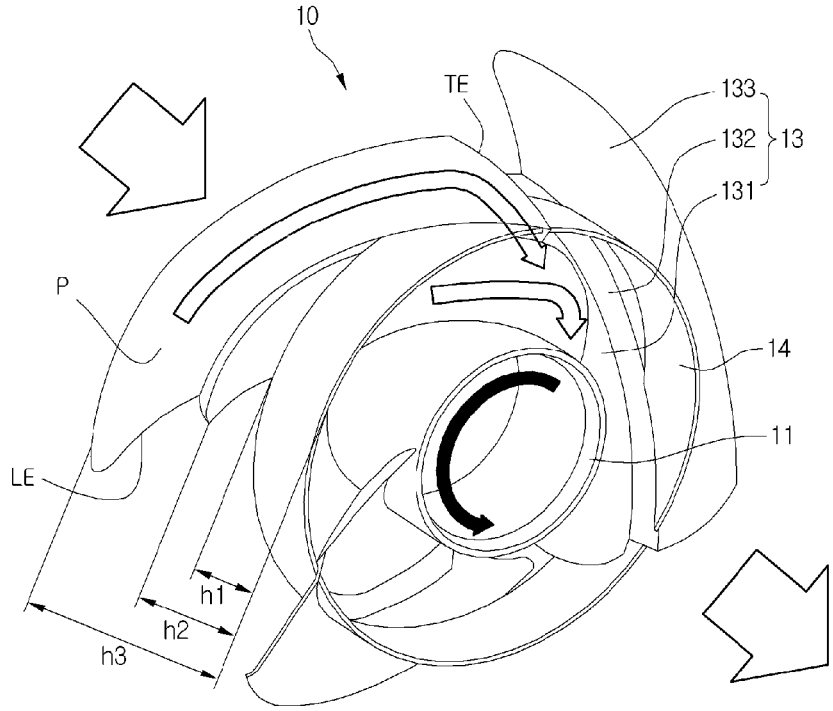
FIG. 2 is a bottom perspective view of a fan assembly for showing an air flow generated while driving a fan assembly according to an exemplary embodiment of the present invention.
Figure 3:
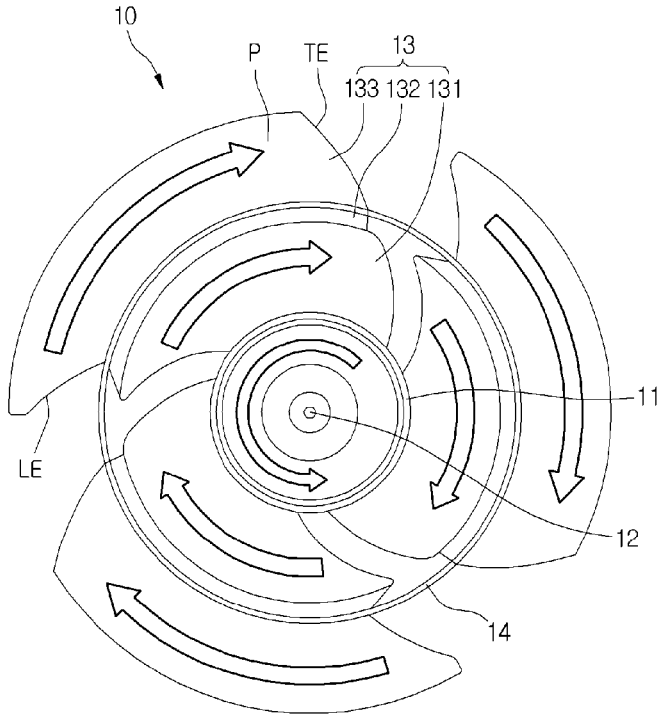
FIG. 3 is a bottom view of the fan assembly.

FIG. 2 is a bottom perspective view of a fan assembly for showing an air flow generated while driving a fan assembly according to an exemplary embodiment of the present invention and FIG. 3 is a bottom view of the fan assembly.

Referring to FIGS. 2 and 3, the fan assembly 10 rotates in a direction in which the leading edge LE first hits air. That is, in the figures, a fan rotates in a black arrow direction. In this case, air in front of the fan assembly 10 flows on the positive pressure surface P of the blade 13.

Specifically, air particles on the positive pressure surface P of the blade 13 stop and thereafter, as the blade 13 rotates, the air particles moves relatively on the positive pressure surface P of the blade 13. In other words, the air particles flow in the circumferential direction of the fan assembly 10 (see FIG. 3). In addition, the flow direction of the air particles is opposite to a rotational direction of the blade 13. Further, since the blade 13 is round to the rear of the fan assembly 10 toward the trailing edge TE from the leading edge LE, the air particles contacting the positive pressure surface P is thus bent to the rear of the fan assembly 10 while rotating in the circumferential direction on the positive pressure surface as shown in the figure (see FIG. 2).

Besides, the air particles which forcibly flow by the round shape of the positive pressure surface P of the blade 13 flow slantly in an outer direction of the blade 13, i.e., in the lateral direction from the center of the fan assembly 10 by the centrifugal force. In addition, by the orifice wrapped around the exterior of the blade 13, the flow direction of the air particles is switched to a direction substantially parallel to an extending direction of the rotational shaft 12. According to the principle, as the blade 13 rotates, air flows from the front to the rear of the fan assembly 10 (see FIG. 2). In addition, a flow velocity of air becomes faster or slower depending on a rotational velocity of the blade 13.

Further, as described above, as air flows to the rear of the fan assembly 10, the pressure of the front area of the blade 13, i.e., the area of the negative pressure surface N is lower than that of the area of the positive pressure surface P. By such a pressure difference, air distributed in front of the fan assembly 10 is forcibly flowed toward the fan assembly 10.

Meanwhile, the blade 13 of the fan assembly 10 according to the exemplary embodiment of the present invention is divided into the first part 131 at the inner side and the second part 133 at the outer side by the bent part 132. In addition, the air that is flowed forcibly in the circumferential direction by the positive pressure surface P of the first part 131 is switched to an axial-direction flow by the first orifice 14. Accordingly, the air that is flowed forcibly by the first part 131 does not flow up to the tip of the blade 13 and is interrupted.

Further, the air that is flowed forcibly in the circumferential direction by the positive pressure surface P of the second part 133 is switched to the axial-direction flow by the second orifice 15.

As such, the air flowed forcibly by the positive pressure surfaces P of the first part 131 and the second part 133 forms an independent air flow by the first orifice 14. That is, each of 2-stage blades forms the independent air flow, and as a result, an air quantity increases. Moreover, the air flowed by the first part 131 is interrupted by the first orifice 14 not to be transferred to the second part 133. Therefore, the air flow is prevented from concentrating on the tip of the blade 13, and as a result, flowing noise can be reduced.

Meanwhile, a height h3 from the bottom of the first orifice 14 to the tip of the leading edge LE of the second part is preferably larger than a height h2 from the bottom of the first orifice 14 to the tip of the leading edge LE of the first part 131. In addition, the height h2 is preferably larger than the height of the first orifice 14.

Specifically, when the first orifice 14 is higher than the end of the leading edge LE of the first part 131 or the end of the leading edge LE of the second part 133, the air flow from the negative pressure surface to the positive pressure surface of the fan assembly 10 may be interfered. Accordingly, the first orifice 14 is preferably formed substantially in the rear surface of the blade 13.

What is claimed is:

1. A fan assembly, comprising:

a hub; and a plurality of blades including a leading edge corresponding to a side hit by air and a trailing edge corresponding to an opposite side of the leading edge, the plurality of blades configured to be extended radially from an outer peripheral surface of the hub, each of the plurality of blades including:

a first part extended radially from the outer peripheral surface of the hub;

a bent part stepped on the end of the first part; and a second part further extended radially on the end of the bent part; and a first orifice formed in the area of the bent part of the blade and switching a part of the air flow generated by the rotation of the plurality of blades to an axial direction.

2. The fan assembly of claim 1, wherein the bent part is stepped towards the rear surface of the blade.

3. The fan assembly of claim 1, wherein the first orifice is integrally formed with the plurality of blades.

4. The fan assembly of claim 1, further comprising a second orifice having a radius slightly larger than a length from the center of the hub to outer tips of the plurality of blades and wrapped around the exterior of the second part.

5. The fan assembly of claim 4, wherein a height h2 from the bottom of the first orifice to the tip of the leading ledge of the first part is larger than a height h1 of the first orifice.

6. The fan assembly of claim 4, wherein a height h3 from the bottom of the first orifice to the tip of the leading edge of the second part is larger than the height h1 of the first orifice.

7. The fan assembly of claim 4, wherein the height h3 from the bottom of the first orifice to the tip of the leading edge of the second part is larger than the height h2 from the bottom of the first orifice to the tip of the leading edge of the first part.

8. The fan assembly of claim 1, wherein the first orifice is extended from the rear surfaces of the plurality of blades.

* * * * *